US011345137B2

(12) United States Patent
Kato et al.

(10) Patent No.: US 11,345,137 B2
(45) Date of Patent: May 31, 2022

(54) PRINTING SYSTEM AND PRINTING METHOD

(71) Applicant: SCREEN HOLDINGS CO., LTD., Kyoto (JP)

(72) Inventors: Takuji Kato, Kyoto (JP); Masafumi Kawagoe, Kyoto (JP); Tomoyuki Komura, Kyoto (JP); Shuji Muramoto, Kyoto (JP); Kuniko Teraki, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/257,780

(22) PCT Filed: May 14, 2019

(86) PCT No.: PCT/JP2019/019089
§ 371 (c)(1),
(2) Date: Jan. 4, 2021

(87) PCT Pub. No.: WO2020/021819
PCT Pub. Date: Jan. 30, 2020

(65) Prior Publication Data

US 2021/0300012 A1 Sep. 30, 2021

(30) Foreign Application Priority Data

Jul. 24, 2018 (JP) ..... JP2018-138450

(51) Int. Cl.
*B41M 1/40* (2006.01)
*B41F 17/20* (2006.01)
(Continued)

(52) U.S. Cl.
CPC ..... *B41F 9/1009* (2013.01); *B41F 15/18* (2013.01); *B41M 1/10* (2013.01); *B41M 1/40* (2013.01)

(58) Field of Classification Search
CPC ..... B41F 15/08; B41F 17/22; B41F 17/20; B41F 17/36; B41M 1/40; H05K 3/1216; H05K 3/1225; H05K 3/1233
See application file for complete search history.

(56) References Cited

U.S. PATENT DOCUMENTS 8,402,639 B2 * 3/2013 Nagao ..... H05K 13/085 29/740
2002/0015086 A1 2/2002 Shiraiwa
(Continued)

FOREIGN PATENT DOCUMENTS

CN 2801474 Y 8/2006
CN 102596579 A 7/2012
(Continued)

OTHER PUBLICATIONS

International Search Report issued in corresponding International Patent Application No. PCT/JP2019/019089, dated Jun. 25, 2019, with English translation.
(Continued)

*Primary Examiner* — Leslie J Evanisko
(74) *Attorney, Agent, or Firm* — McDermott Will & Emery LLP

(57) ABSTRACT

In a forward movement, an article is conveyed to a printing device via a transfer position while being kept mounted in a first holder for printing by the printing device. The article is returned to the transfer position together with the first holder after printing. An article to be printed after the above article is mounted into a second holder in parallel with at least a part of the forward movement, the printing and a return movement. This is capable of printing on the articles in a short
(Continued)

throughput time also when the articles are those having a three-dimensional shape such as bottles and in-vehicle components.

5 Claims, 3 Drawing Sheets

(51) Int. Cl.

| | |
|---|---|
| ***B41F 9/10*** | (2006.01) |
| ***B41M 1/10*** | (2006.01) |
| ***B41F 15/18*** | (2006.01) |

(56) References Cited

U.S. PATENT DOCUMENTS

| | | | |
|---|---|---|---|
| 2005/0145331 | A1 | 7/2005 | Dewig et al. |
| 2012/0199021 | A1 | 8/2012 | Till |
| 2014/0049585 | A1 | 2/2014 | Tashiro et al. |
| 2014/0083359 | A1 | 3/2014 | Miyake et al. |
| 2014/0170304 | A1 | 6/2014 | Fujimoto |
| 2015/0009524 | A1 | 1/2015 | Fujimoto et al. |
| 2015/0245500 | A1 | 8/2015 | Murakami et al. |
| 2016/0023459 | A1 | 1/2016 | Till |
| 2016/0031204 | A1 | 2/2016 | Fujimoto |

FOREIGN PATENT DOCUMENTS

| | | | |
|---|---|---|---|
| CN | 104883826 | A | 9/2015 |
| CN | 104960323 | A | 10/2015 |
| CN | 204955736 | U | 1/2016 |
| CN | 106427209 | A | 2/2017 |
| CN | 206938156 | U | 1/2018 |
| JP | 2004-344803 | A | 12/2004 |
| JP | 2012-250377 | A | 12/2012 |
| JP | 2013-169723 | A | 9/2013 |
| JP | 2013-220596 | A | 10/2013 |
| JP | 2017-132052 | A | 8/2017 |
| JP | 2018-027659 | A | 2/2018 |
| KR | 10-2009-0038568 | A | 4/2009 |
| KR | 10-2014-0079728 | A | 6/2014 |
| TW | 550185 | B | 9/2003 |

OTHER PUBLICATIONS

Taiwanese Office Action issued in corresponding Taiwanese Patent Application No. 108117056, dated Apr. 14, 2021, with English translation.

Chinese Office Action issued in corresponding Chinese Patent Application No. 201980039880.4, dated Nov. 22, 2021.

Korean Grant of Patent issued in corresponding Korean Patent Application No. 10-2020-7037224, dated Feb. 28, 2022, with Engilsh translation.

* cited by examiner

PRINTING SYSTEM AND PRINTING METHOD

CROSS REFERENCE TO RELATED APPLICATION

This application is the U.S. National Phase under 35 U.S.C. § 371 of International Application No. PCT/JP2019/019089, filed on May 14, 2019, which claims the benefit of Japanese Application No. 2018-138450, filed on Jul. 24, 2018, the entire contents of each are hereby incorporated by reference.

TECHNICAL FIELD

This invention relates to a printing system and a printing method for applying a printing process to articles having a three-dimensional shape such as daily commodities including bottles and in-vehicle components.

BACKGROUND ART

Intaglio printing has a property of being able to print a pattern incised in an intaglio with higher reproducibility than printing methods such as screen printing and ink-jet printing. Utilizing this property, an attempt has been made to form an electrode pattern in a device such as an electronic circuit board or a touch panel board by intaglio printing (patent literature 1). Further, a printing device described in the above patent literature 1 performs printing on one principal surface, i.e. a flat surface, of a board, but a technique for printing on a curved surface has also been proposed (see patent literature 2).

CITATION LIST

Patent Literature

[Patent literature 1] JP 2018-27659A
[Patent literature 1] JP 2017-132052A

SUMMARY OF INVENTION

Technical Problem

Articles handled by these printing devices are flat plate works having a flat non-printing surface. Thus, a single article can be conveyed to a position for intaglio printing (corresponding to an "alignment position" of the invention) while being kept in a posture suitable for printing by a conventional conveyance technique such as a conveyor and a printing process can be performed by a printing unit. However, to perform the printing process for articles having a three-dimensional shape such as daily commodities including bottles and in-vehicle components, it is necessary to provide a holding mechanism conforming to the shape of the articles at the alignment position and mount the article in the holding mechanism immediately before printing on the article is performed.

Since such article mounting is associated with a complicated operation, a mounting tact necessarily becomes long. This is one of main factors reducing a throughput of the printing process for printing on articles having a three-dimensional shape.

This invention was developed in view of the above problem and aims to provide a printing system and a printing method capable of printing on articles in a short throughput time also when the articles are those having a three-dimensional shape such as bottles and in-vehicle components.

Solution to Problem

One aspect of the invention is a printing system, comprising: a circulating conveyor device including a holder conveying mechanism for conveying a holder configured such that an article is removably mountable thereinto, the circulating conveyor device circulatingly conveying the holder along a circulation path having a mounting position where the article is mounted into the holder and a transfer position different from the mounting position; a printing device arranged away from the circulating conveyor device while facing the transfer position, the printing device printing on the article positioned at an alignment position; and a reciprocally moving device that positions the article at the alignment position by moving the holder having the article mounted therein to the printing device and returning the holder to the transfer position after printing on the article by the printing device; wherein, when the holder having the article mounted therein is a first holder and the holder having the article not mounted therein is a second holder, the circulating conveyor device stops the second holder at the mounting position while an article different from the article mounted in the first holder is mounted into the second holder in parallel with at least one of a forward movement of the first holder to the alignment position by the reciprocally moving device, printing on the article by the printing device and a return movement of the first holder to the transfer position by the reciprocally moving device.

Other aspect of the invention is a printing method for printing on an article by a printing device, comprising: a transfer conveyance step of conveying a first holder having the article before printing mounted therein to a transfer position facing the printing device; a forward movement step of moving the first holder from the transfer position to the printing device and positioning the article at an alignment position; a printing step of printing on the article with the article positioned at the alignment position; a return movement step of returning the first holder having the printed article mounted therein from the printing device to the transfer position; and an article mounting step of mounting an article different from the article mounted in the first holder into a second holder different from the first holder at a mounting position separated from the printing device and the transfer position in parallel with at least one of the forward movement step, the printing step and the return movement step.

In the invention thus configured, the article is conveyed to the printing device via the transfer position while being kept mounted in the first holder, and returned to the transfer position together with the first holder after printing with the article positioned at the alignment position of the printing device. On the other hand, the article to be printed after the above article is mounted into the second holder at the mounting position separated from the printing device and the transfer position in parallel with at least a part of such a print-related process (forward movement, printing and return movement). That is, a mounting process of the article into the holder and the print-related process are performed partially or entirely in parallel.

[Effect]

As described above, since the article is mounted into the holder in parallel with the conveyance of the article kept mounted in the holder to the printing device and printing on the article, printing on the article can be performed in a short throughput time also when the article is the one having a three-dimensional shape such as a bottom or an in-vehicle component.

All of a plurality of constituent elements of each aspect of the invention described above are not essential and some of the plurality of constituent elements can be changed, deleted or replaced by new other constituent elements or limitation contents can be partially deleted as appropriate to solve some or all of the problems described above or achieve some or all of effects described in this specification.??Further, some or all of technical features included in one aspect of the invention described above can be combined with some or all of technical features included in another aspect of the invention described above into one independent aspect of the invention to solve some or all of the problems described above or achieve some or all of effects described in this specification.

DESCRIPTION OF EMBODIMENTS

Figure 1:
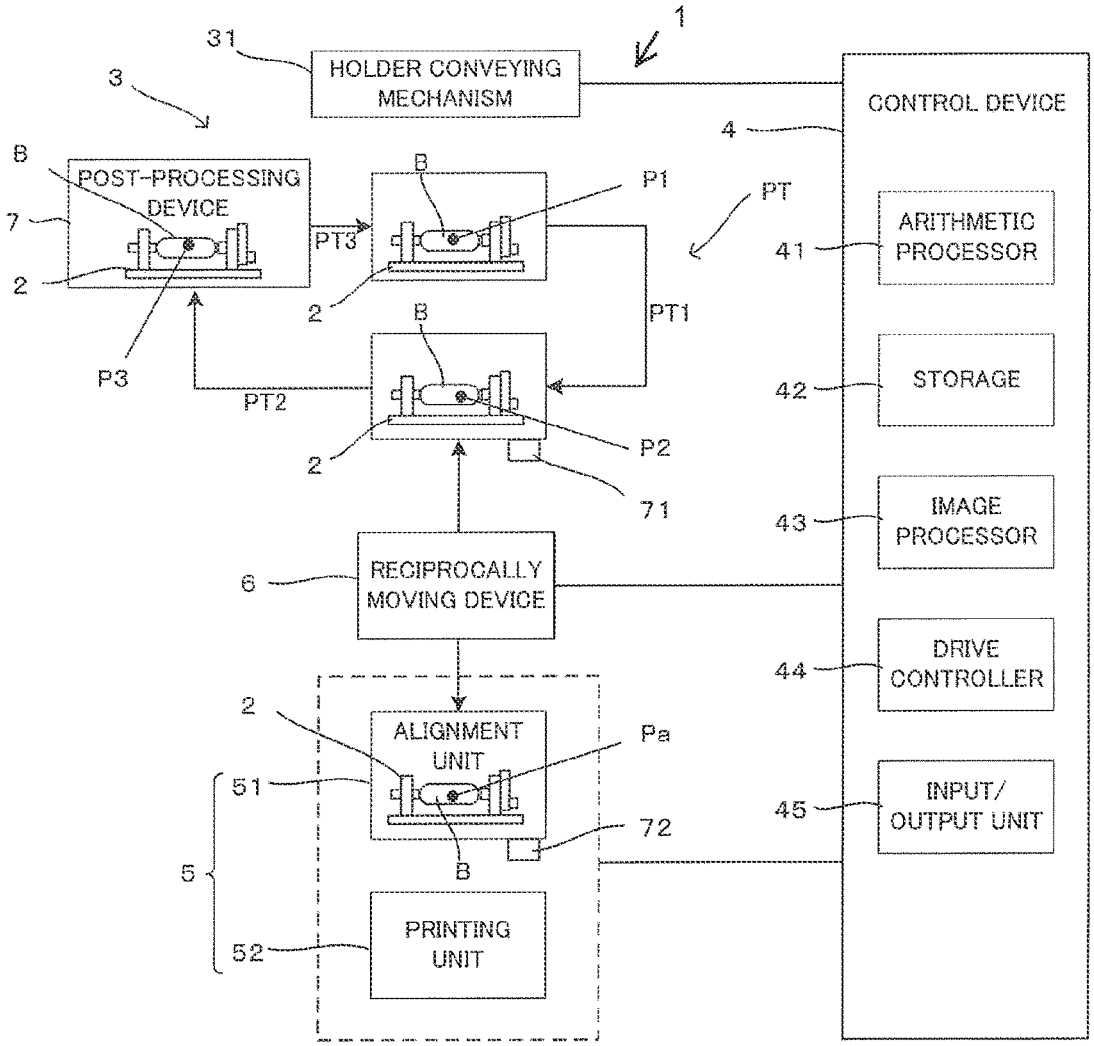
FIG. 1 is a diagram showing one embodiment of a printing system according to this invention.
Figure 2:
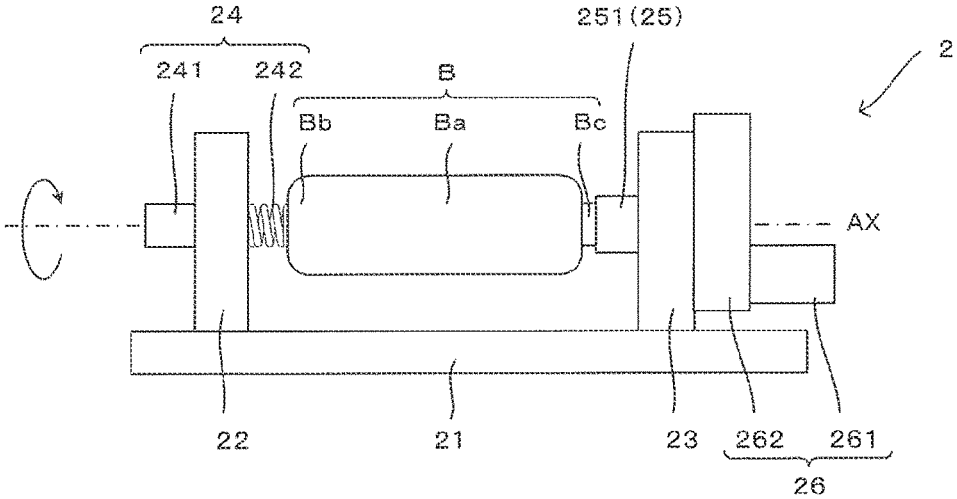
FIG. 2 is a schematic diagram showing the structure of a holder used in the printing system of FIG. 1.

FIG. 1 is a diagram showing one embodiment of a printing system according to this invention. FIG. 2 is a schematic diagram showing the structure of a holder used in the printing system of FIG. 1. This printing system 1 directly prints a pattern of an ultraviolet curable material on a trunk part Ba of a container B with the container B such as a beverage glass bottle or a glass bottle of a cosmetic article, which is an example of an "article" of the invention, mounted in a holder 2.

The printing system 1 is provided with a circulating conveyor device 3. The circulating conveyor device 3 includes a holder conveying mechanism 31 for conveying the holder 2 along a circulation path PT having a container exchange position P1, a transfer position P2 and a post-processing position P3. The holder conveying mechanism 31 operates in response to a command from a drive controller 44 of a control device 4 for controlling the entire printing system 1 and circulatingly moves the holder 2 in an order of the container exchange position P1, the transfer position P2 and the post-processing position P3. A conveyor conveying mechanism for simultaneously conveying the holder 2 from the container exchange position P1 to the transfer position P2 (hereinafter, referred to as "transfer conveyance M1"), moving the holder 2 from the transfer position P2 to the post-processing position P3 (hereinafter, referred to as "post-processing conveyance M2") and moving the holder 2 from the post-processing position P3 to the container exchange position P1 (hereinafter, referred as "exchange conveyance M3") or an independent conveying mechanism for performing the transfer conveyance M1, the post-processing conveyance M2 and the exchange conveyance M3 independently of each other may be used as the holder conveying mechanism 31. Note that the independent conveying mechanism is used in this embodiment.

A sensor is arranged at each of the container exchange position P1, the transfer position P2 and the post-processing position P3. The sensors detect the holders 2 located at the container exchange position P1, the transfer position P2 and the post-processing position P3 and give signals indicating those to an input/output unit 45 of the control device 4. An arithmetic processor 41 of the control device 4 obtains the positions of the holders 2 configured as described next and the containers B mounted in the holders 2 based on these signals. Note that, out of the above sensors, the one provided at the transfer position P2 contributes to controlling a reciprocal movement of the holder 2 together with a sensor provided at an alignment position as described in detail later.

As shown in FIG. 2, the holder 2 includes a base part 21. Two column parts 22, 23 stand from the upper surface of this base part 21. The column parts 22, 23 are provided to face each other while being spaced apart a distance slightly longer than a height (length from a bottom part to a container opening) of the container B. Although not shown, a through hole is provided in a height direction of the container B (lateral direction of FIG. 2) in each of the column parts 22, 23. These through holes are arranged in a row along the height direction. A bottom holding part 24 is provided in the through hole provided in the column part 22, whereas a lid closing holding part 25 is provided in the through hole provided in the column part 23.

The bottom holding part 24 includes a rotary body 241 provided rotatably with respect to the column part 22 and a spring member 242 mounted on the rotary body 241. One end part of the spring member 242 is a fixed end fixed to the rotary body 241, and the other end part is a free end extending toward the column part 23. On the other hand, the lid closing holding part 25 includes a coupling member 251 removably attachable to a lid closing part Bc while being supported rotatably with respect to the column part 23. Thus, as shown in FIG. 2, the container B can be arranged in a horizontal state between the column parts 22 and 23 while a bottom part Bb of the container B is pressed toward the other end part of the spring member 242 against a biasing force of the spring member 242. Further, by coupling the lid closing part Bc of the container B to the coupling member 251 of the lid closing holding part 25, the container B is held rotatably about an axis of rotation AX while being sandwiched by the rotary body 241 and the coupling member 251 with the biasing force of the spring member 242. Note that the lid closing part Bc means a part where a lid (not shown) of the container B is mounted, out of an upper end range from a shoulder part of the trunk part Ba to the container opening. The container opening is open in the upper end (right end of FIG. 2) of this lid closing part Bc, and an external thread (not shown) is formed as appropriate from the vicinity of the container opening toward the trunk part Ba. The external thread may have such a shape partially divided as appropriate besides being a continuous spiral external thread.

In the holder 2 configured as just described, the container B can be mounted and removed by an operator when being positioned at the container exchange position P1. That is, the container B can be mounted into the holder 2 by coupling the lid closing part Bc of the container B to the coupling member 251 of the lid closing holding part 25 after the container B is arranged in a horizontal state between the column parts 22, 23 while the bottom part Bb of the container B before printing is pressed against the spring member 242. Further, by moving the printed container B in the holder 2 toward the column part 22 against the biasing force of the spring member 242 and releasing the coupling of the lid closing part Bc by the coupling member 251 after printing, the container B can be removed from the holder 2. Note that a mounting/removing method of the container B into and from the holder 2 is not limited to this and a mounting/removing method corresponding to a holding function of the container B in the holder 2 can be employed.

The holder 2 has a rotating function of rotating the container B about the axis of rotation AX during intaglio printing by a printing device to be described later besides the holding function of merely rotatably holding the container B in a horizontal state. This rotating function is performed by a container rotator 26. This container rotator 26 includes a rotating motor 261 and a rotation transmitting mechanism 262 for transmitting a rotational force of the motor 261 to the lid closing part Bc of the container B. If the motor 261 operates in response to a rotation command from the drive controller 44 of the control device 4, the container B before printing rotates about the axis of rotation AX while being held in a horizontal state by being sandwiched by the bottom holding part 24 and the lid closing holding part 25.

The holder 2 having the container B before printing mounted thereinto by the operator is conveyed along a path PT1 from the container exchange position P1 toward the transfer position P2, out of the circulation path PT, by the holder conveying mechanism 31. That is, the transfer conveyance M1 (see FIG. 3) is performed, and the container B before printing is conveyed to the transfer position P2 together with the holder 2. A printing device 5 is arranged at a position separated from the circulating conveyor device 3 while facing this transfer position P2. As shown in FIG. 1, the printing device 5 includes an alignment unit 51 arranged at an alignment position Pa facing the transfer position P2 and a printing unit 52 for directly printing a pattern of an ultraviolet curable material on the trunk part Ba of the container B mounted in the holder 2 positioned at the alignment position Pa.

The alignment unit 51 is provided to make a posture of the container B mounted in the holder 2 with respect to the printing unit 52, i.e. a relative positional relationship of the container B and the printing unit 52, suitable for printing. In this embodiment, the holder 2 is relatively moved by a position adjuster (not shown) based on an alignment image obtained by imaging a part of the container B by an unillustrated camera to correct the posture of the container B. A conventionally known means can be used for posture correction. For example, a plurality of images are obtained by imaging a plurality of characteristic parts, alignment marks or the like included in the container B, and those images are processed by an image processor 43 of the control device 4. Then, based on image data obtained thereby, the arithmetic processor 41 three-dimensionally moves the holder 2 at the alignment position Pa to relatively move the container B with respect to the printing unit 52 and correct the posture of the container B with respect to the printing unit 52 to a reference state. The container B is printed by the printing unit 52 after this posture correction.

The printing unit 52 performs basically the same printing method as in patent literature 1, i.e. intaglio printing. That is, the printing unit 52 causes a transfer roller to receive a pattern of an ultraviolet curable material corresponding to an intaglio by pressing the intaglio filled with the ultraviolet curable material against the transfer roller. Further, the pattern on the transfer roller is transferred to the trunk part Ba of the container B while the container B corrected in the reference printing posture is rotated about the axis of rotation AX (see FIG. 2) in synchronization with the rotation of the transfer roller. Further, although not shown in FIG. 1, the printing unit 52 includes a temporary curing processor for causing so-called temporary curing by irradiating relatively weak ultraviolet rays to the pattern of the ultraviolet curable material transferred to the container B.

As just described, in this embodiment, the printing device 5 is provided separately from the circulating conveyor device 3 and the container B can be printed independently of a circulating conveying movement of circulatingly conveying the container B together with the holder 2 by the circulating conveyor device 3. Further, a reciprocally moving device 6 is provided in the printing system 1 to correspond to the separate arrangement of the circulating conveyor device 3 and the printing device 5.

The reciprocally moving device 6 has a shuttle configuration of reciprocally moving a base (not shown), on which the holder 2 having the container B mounted therein can be placed, between the transfer position P2 and the alignment position Pa. A mechanism configured by combining a linear guide and a motor, a mechanism constituted by a linear actuator such as an air cylinder or the like can be, for example, used as a specific configuration for moving the base.

In this embodiment, sensors 71, 72 for detecting the base are respectively provided at the transfer position P2 and the alignment position Pa, and the control device 4 controls the reciprocally moving device 6 based on detection signals from the respective sensors 71, 72. In this way, the container B can be positioned at the alignment position Pa by moving the holder 2 having the container B mounted therein to the printing device 5, and the holder 2 can be returned to the transfer position P2 after printing by the printing device 5.

The holder 2 returned to the transfer position P2 in this way is conveyed along a path PT2 from the transfer position P2 to the post-processing position P3, out of the circulation path PT, by the holder conveying mechanism 31. That is, the post-processing conveyance M2 (see FIG. 3) is performed and the printed container B is conveyed to the post-processing position P3 together with the holder 2. A post-processing device 7 for performing a so-called main curing process by further irradiating relatively strong ultraviolet rays to the container B already temporarily cured in the printing device 5 is arranged at the post-processing position P3. Note that the holder 2 having the container B subjected to the main curing process by the post-processing device 7 mounted therein is conveyed along a path PT3 from the post-processing position P3 toward the container exchange position P1, out of the circulation path PT, by the holder conveying mechanism 31. That is, the exchange conveyance M3 (see FIG. 3) is performed, and the printed container B is conveyed to the container exchange position P1 together with the holder 2. Then, the printed container B is removed from the holder 2 by the operator at this container exchange position P1.

The control device 4 is provided with a storage 42 for storing a print program for performing a printing operation, various pieces of data and the like, besides the above arithmetic processor 41, image processor 43, drive controller 44 and input/output unit 45. The arithmetic processor 41 reads out the print program from the storage 42, and performs a printing process to be described in detail next by controlling each component of the system in accordance with the print program.

Figure 3:
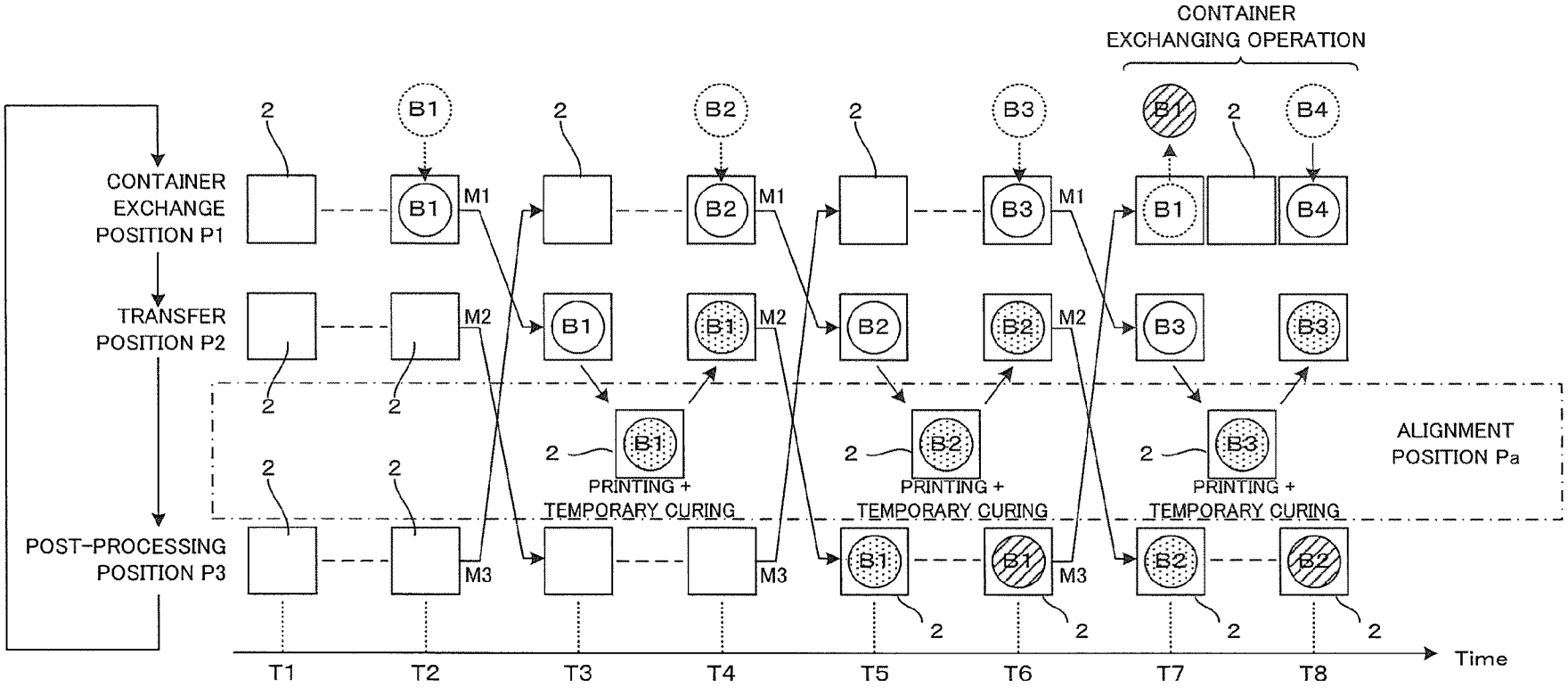
FIG. 3 is a diagram schematically showing the printing process for the container performed in the printing system shown in FIG. 1.

FIG. 3 is a diagram schematically showing the printing process for the container performed in the printing system shown in FIG. 1. In FIG. 3, parts of vertical axes except a dashed-dotted line part represent the positions of the holders 2 and the containers B, and a horizontal axis represents elapsed time. Further, outlined white squares represent the holders 2. Further, outlined white circles represent the containers B before printing, dotted circles represent the containers subjected to the printing process and the temporary curing process, and hatched circles represent the containers as final products subjected to the main curing process. Further, "B1", "B2", "B3" and "B4" in the circles respectively indicate the first, second, third and fourth containers B. Further, broken lines in FIG. 3 indicate that the holder 2 is in a stopped state, and solid-line arrows indicate movements and moving directions of the holders 2.

In an initial state (timing T1 of FIG. 3) of the printing system 1, so-called empty holders 2 having no container B mounted therein are positioned at the container exchange position P1, the transfer position P2 and the post-processing position P3. If the operator gives an operation command to the control device 4, the arithmetic processor 41 controls each component of the system and repeatedly performs the following series of operations in accordance with the print program.

If it is confirmed that the operator has manually mounted the first container B1 before printing into the holder 2 positioned at the container exchange position P1 (timing T2), the holder conveying mechanism 31 conveys the holder 2 having the container B1 mounted therein along the path PT1 (transfer conveyance M1). Further, in synchronization with this, the holder conveying mechanism 31 conveys the empty holders 2 located at the transfer position P2 and the post-processing position P3 respectively along the paths PT2, PT3. That is, the post-processing conveyance M2 and the exchange conveyance M3 are performed. In this way, the first container B1 is located at the transfer position P2 and the empty holders 2 are located at the container exchange position P1 and the post-processing position P3 (timing T3).

If the holder 2 having the container B1 before printing mounted therein is conveyed to the transfer position P2, this holder 2 is moved to the alignment position Pa by the reciprocally moving device 6 (forward movement). At this alignment position Pa, the position of the holder 2 is moved by the alignment unit 51 to correct the posture of the container B1 mounted in this holder 2 with respect to the printing unit 52. After this posture correction, a pattern of the ultraviolet curable material is printed on the trunk part Ba of the container B1 kept mounted in the holder 2 by the printing unit 52, and the printed pattern is further temporarily cured. If printing and temporary curing on the container B1 are completed in this way, a return movement of the holder 2 is carried out by the reciprocally moving device 6. That is, the holder 2 is returned to the transfer position P2 by the reciprocally moving device 6 while holding the container B1 (timing T4).

In parallel with the reciprocal moving operation of the holder 2 to and from the alignment position Pa, the printing operation, the temporary curing operation and the return moving operation of the holder 2 to the transfer position P2 performed in this way, the operator manually mounts the second container B2 before printing into the holder 2 stopped at the container exchange position P1. Note that although the container B is manually exchanged using an entire time from timing T3 to timing T4 in this embodiment, the container B2 may be mounted into the holder 2 in parallel with at least some of the forward moving operation, the printing operation, the temporary curing operation and the return moving operation. Further, a series of operations including a forward movement, printing, temporary curing and a return movement is referred to as a "print-related process" below for the convenience of description.

If the holder 2 having the container B1 subjected to printing and temporary curing mounted therein returns to the transfer position P2, the holders 2 located at the container exchange position P1, the transfer position P2 and the post-processing position P3 are respectively conveyed to the transfer position P2, the post-processing position P3 and the container exchange position P1. That is, as shown in FIG. 3, the transfer conveyance M1, the post-processing conveyance M2 and the exchange conveyance M3 are performed (timing T5). Then, the holder 2 is conveyed to the post-processing position P3, and the holder 2 having the container B1 mounted therein is returned to the container exchange position P1 after the main curing process is performed as a post-process following the printing process to the trunk part Ba of the container B1 mounted in the holder 2 from timing T5 to timing T6. Further, from timing T5 to timing T6, the print-related process for the second container B2 and the mounting process of the third container B3 into the holder 2 are performed in parallel in the same way as above.

Further, if the holder 2 having the container B2 subjected to printing and temporary curing mounted therein returns to the transfer position P2, the holders 2 located at the container exchange position P1, the transfer position P2 and the post-processing position P3 are respectively conveyed to the transfer position P2, the post-processing position P3 and the container exchange position P1. That is, as shown in FIG. 3, the transfer conveyance M1, the post-processing conveyance M2 and the exchange conveyance M3 are performed (timing T7). The container B1 subjected to the printing process, the temporary curing process and the main curing process and having the pattern firmly fixed to the trunk part Ba is mounted in the holder 2 conveyed to the container exchange position P1 as shown in FIG. 3. Accordingly, a container exchanging operation is performed from timing T7 to timing T8. That is, after the operator manually removes the printed container B1 from the holder 2 stopped at the container exchange position P1, the fourth container B4 before printing is manually mounted into the holder 2. Further, in parallel with such a container exchanging operation, the main curing process for the second container B2 and the printing process and the temporary curing process for the third container B3 are performed.

Note that, thereafter, every time the holders 2 are intermittently conveyed along the circulation path PT, the container exchanging operation of the $N^{th}$ (where N is a natural number equal to or greater than 2) printed container BN and the $(N+3)^{th}$ container B(N+3) before printing at the container exchange position P1, the print-related process for the $(N+2)^{th}$ container B(N+2) and the main curing process for the $(N+1)^{th}$ main curing process are performed in parallel.

As described above, according to this embodiment, the container B having a three-dimensional shape is mounted into the holder 2, and the pattern is printed on the trunk part Ba of the container B kept in the mounted state by the printing device 5. Thus, the pattern can be satisfactorily printed by the printing unit 52 regardless of the shape of the container B. Further, since the posture of the container B with respect to the printing unit 52 is corrected by the alignment unit 51 before printing by the printing unit 52 in the printing device 5, printing can be constantly performed in a proper printing posture and printing accuracy can be enhanced. Particularly, in a printing system in which a plurality of printing devices 5 are installed in parallel and a plurality of patterns are superimposed on the same container B as described later, the misalignment of the patterns can be suppressed and a high-quality image can be printed on the container B having a three-dimensional shape.

Further, a certain period of time is necessary for an operation of manually mounting the container B having a three-dimensional shape into the holder 2 and manually removing the container B from the holder 2. This may become one of factors reducing throughput. However, in this embodiment, the above manual operation is performed in parallel with at least a part of the print-related process (forward movement, printing, temporary curing and return movement). That is, the mounting operation of the container B into the holder 2 and the removing operation of the container B from the holder 2 are performed partially or entirely in parallel with the print-related process and the main curing process (post-process). As a result, printing on the container B can be performed in a short throughput time.

In the above embodiment, the container B corresponds to an example of an "article" of the invention. Further, the holder conveying mechanism 31 corresponds to an example of a "conveying mechanism" of the invention. Further, the container exchange position P1 corresponds to an example of a "mounting position" of the invention. Further, for example, from timing T3 to timing T4, the holder 2 having the container B1 mounted therein corresponds to an example of a "first holder" of the invention, the empty holder 2 conveyed from the post-processing position P3 to the container exchange position P1 corresponds to an example of a "second holder" of the invention and the container B2 mounted in the empty holder 2 corresponds to an example of an "article different from the article mounted in the first holder" of the invention. Further, a step of conveying the holder 2 having the container B before printing mounted therein to the transfer position P2 along the path PT1 corresponds to an example of a "transfer conveyance step" of the invention, the forward movement, the printing and the return movement respectively correspond to examples of a "a forward movement step", a "printing step" and a "return movement step" of the invention, and the mounting of the container B at the container exchange position P1 corresponds to an example of an "article mounting step" of the invention.

Figure 4:
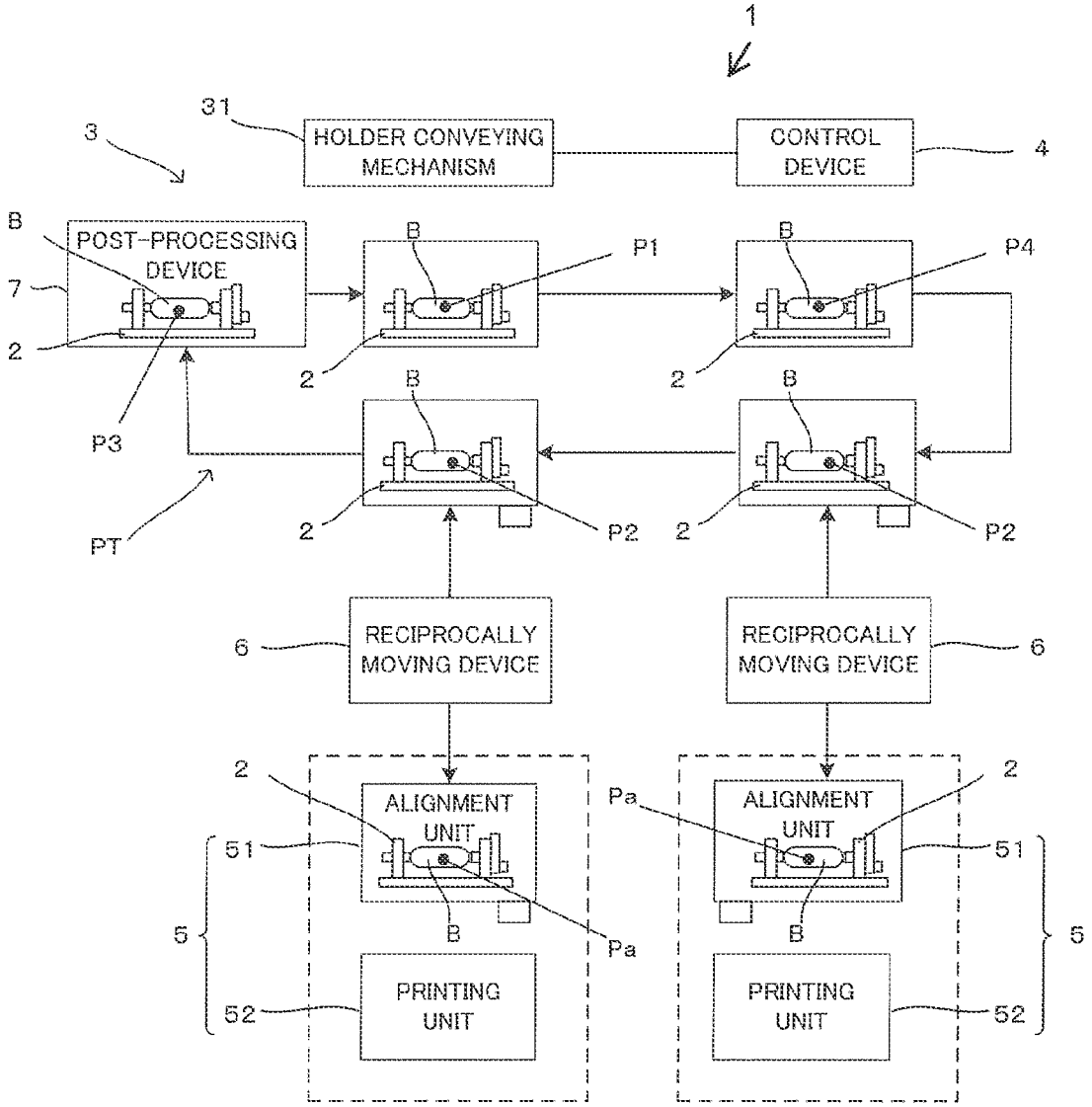
FIG. 4 is a diagram showing the other embodiment of the printing system according to this invention.

Note that the invention is not limited to the above embodiment and various changes other than the aforementioned ones can be made without departing from the scope of the invention. For example, although the invention is applied to the printing system 1 provided with only one printing device 5 in the above embodiment, the invention can be applied also to a printing system 1, for example, provided with two printing devices 5 as shown in FIG. 4. In this case, a circulation path PT may be extended, two transfer positions P2, P2 are provided in the circulation path PT and the printing device 5 and a reciprocally moving device 6 may be provided at each transfer position P2.

Further, in the above embodiment, as shown in FIG. 3, the holders 2 located at the container exchange position P1, the transfer position P2 and the post-processing position P3 are respectively conveyed in synchronization to the transfer position P2, the post-processing position P3 and the container exchange position P1 every time the container exchanging process (including only the mounting operation), the print-related process (forward movement, printing, temporary curing and return movement) and the main curing process are all completed. A conveyance mode of the holders 2 is not limited to this and may be changed as appropriate according to distances of the paths PT1 to PT3. Further, as shown in FIG. 4, a buffer position P4 where the holder 2 is caused to temporarily wait may be provided to adjust a conveyance timing of the holder 2. Note that the buffer position P4 is not limited to the one shown in FIG. 4 and can be provided at an arbitrary position in the circulation path PT according to tact times of the container exchanging process, the print-related process and the main curing process.

Further, although the post-processing device 7 is provided in the above embodiment, it is not necessary to install the post-processing device 7, for example, if the pattern can be satisfactorily fixed to the container B by ultraviolet irradiation in the printing unit 52. That is, the post-processing device 7 is not an essential component, but an arbitrary component in the invention.

Further, although the position adjuster is provided in the printing device 5 to adjust the posture of the container B with respect to the printing unit 52 in the above embodiment, a position adjuster may be provided in the reciprocally moving device 6. That is, the posture of the container B may be adjusted during or immediately after the forward movement of the holder 2 having the container B before printing mounted therein to the alignment position Pa by the reciprocally moving device 6, and printing may be performed with the holder 2 held by the reciprocally moving device 6.

Further, although the container exchange position P1 not only functions as the "mounting position" of the invention, but also the printed container B is removed from the holder 2 at the container exchange position P1 in the above embodiment, the container B may be removed on a side closer to the post-processing device 7 than the container exchange position P1.

Further, although the mounting/removing operation of the container B into/from the holder 2 is performed by the operator in the above embodiment, the mounting operation and the removing operation may be performed by a robot.

Further, although the pattern of the ultraviolet curable material is printed on the container B as the "article" of the invention in the above embodiment, the invention can be applied also to a printing technique for printing a pattern on articles having a three-dimensional shape such as in-vehicle components other than containers.

Furthermore, although the invention is applied to the printing system 1 provided with the printing device 5 for performing intaglio printing in the above embodiment, the invention can be applied also to a printing technique provided with a printing device for printing on articles having a three-dimensional shape such as containers B and in-vehicle components by another method.

Although the invention has been described by way of the specific embodiments above, this description is not intended to be interpreted in a limited sense. By referring to the description of the invention, various modifications of the disclosed embodiments will become apparent to a person skilled in this art similarly to other embodiments of the invention. Hence, appended claims are thought to include these modifications and embodiments without departing from the true scope of the invention.

INDUSTRIAL APPLICABILITY

The invention is generally applicable to printing techniques for applying a printing process to articles having a three-dimensional shape such as daily commodities including bottles and in-vehicle components.

REFERENCE SIGNS LIST

1 printing system
2 holder
3 circulating conveyor device
5 printing device

6 reciprocally moving device
31 holder conveying mechanism
51 alignment unit
52 printing unit
B, B1, B2, B3, B4 container
M1 transfer conveyance
M2 post-processing conveyance
M3 exchange conveyance
P1 container exchange position
P2 transfer position
P3 post-processing position
PT3 path
Pa alignment position
PT circulation pat

The invention claimed is:

1. A printing system, comprising:

a circulating conveyor device including a holder conveying mechanism for conveying a holder configured such that an article is removably mountable thereinto, the circulating conveyor device circulatingly conveying the holder along a circulation path having a mounting position where the article is mounted into the holder and a transfer position different from the mounting position;

a printing device arranged away from the circulating conveyor device while facing the transfer position, the printing device printing on the article positioned at an alignment position; and a reciprocally moving device that positions the article at the alignment position by moving the holder having the article mounted therein to the printing device and returning the holder to the transfer position after printing on the article by the printing device;

wherein, when the holder having the article mounted therein is a first holder and the holder having the article not mounted therein is a second holder, the circulating conveyor device stops the second holder at the mounting position while an article different from the article mounted in the first holder is mounted into the second holder in parallel with at least one of a forward movement of the first holder to the alignment position by the reciprocally moving device, printing on the article by the printing device and a return movement of the first holder to the transfer position by the reciprocally moving device.

2. The printing system according to claim 1, wherein:

the printing device includes:

a printing unit that prints on the article kept mounted in the first holder, and an alignment unit that adjusts a posture of the article with respect to the printing unit by correcting a position of the first holder at the alignment position.

3. The printing system according to claim 2, wherein:

the alignment unit includes a position adjuster that relatively moves the first holder with respect to the printing unit and a camera that images a part of the first holder or the article mounted in the first holder, and adjusts a relative position of the article with respect to the printing unit by moving the position adjuster based on an image captured by the camera.

4. The printing system according to claim 1, wherein:

the article printed by the printing device is removable from the first holder at the mounting position in the circulating conveyor device.

5. A printing method for printing on an article by a printing device, the article being mounted in a holder, the method comprising:

a transfer conveyance step of conveying a first holder having the article before printing mounted therein to a transfer position;

a forward movement step of moving the first holder from the transfer position to the printing device and positioning the article at an alignment position;

a printing step of printing on the article with the article positioned at the alignment position;

a return movement step of returning the first holder having the printed article mounted therein from the printing device to the transfer position; and an article mounting step of mounting an article different from the article mounted in the first holder into a second holder different from the first holder at a mounting position in parallel with at least one of the forward movement step, the printing step and the return movement step, wherein the first holder is the holder having the article mounted therein and the second holder is the holder having the article not mounted therein, the holder is configured such that the article is removably mountable in the holder and the article is circulatingly conveyed along a circulation path, and the circulation path includes a mounting position at which the article is mounted into the holder and the transfer position that is different from the mounting position and that faces the printing device.

* * * * *